US006088550A

United States Patent [19]

Asai et al.

[11] Patent Number: 6,088,550

[45] **Date of Patent: *Jul. 11, 2000**

[54] IMAGE FORMING APPARATUS WITH SECTION-BASED MANAGEMENT FUNCTION

[75] Inventors: Hiroyuki Asai, Okazaki; Yoichi Kawabuchi, Toyokawa, both of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/749,793

[22] Filed: Nov. 15, 1996

[30] Foreign Application Priority Data

Nov. 20, 1995 [JP] Japan ..... 7-300953

[51] Int. Cl.[7] ..... G03G 15/00

[52] U.S. Cl. ..... 399/79; 399/9

[58] Field of Search ..... 399/8, 9, 83, 85, 399/79, 80; 358/296; 364/464.01; 395/114–6; 377/13, 14, 15, 16; 705/400

[56] References Cited

U.S. PATENT DOCUMENTS 4,870,589 9/1989 Takahata et al. ..... 705/400
5,066,977 11/1991 Yoshizuka ..... 399/80
5,206,735 4/1993 Gauronski et al. .
5,608,494 3/1997 Ogura et al. ..... 399/366
5,706,412 1/1998 Kojo ..... 395/113

FOREIGN PATENT DOCUMENTS 60-218668 11/1985 Japan .
62-96963 5/1987 Japan .

*Primary Examiner*—Joan Pendegrass
*Attorney, Agent, or Firm*—Burns, Doane, Swecker & Mathis, LLP

[57] ABSTRACT

If an input number exceeds a section remaining number, an image forming apparatus executes a processing of displaying a warning notifying that the input number exceeds the section remaining number. If a rounding off processing is possible, the input number is changed to be within the section remaining number and the set number is automatically reduced. As a result, an image forming apparatus capable of giving an alarm or automatically changing a set number into a possible number of prints if the set number exceeds the possible number of prints upon setting is provided.

21 Claims, 14 Drawing Sheets

IMAGE FORMING APPARATUS WITH SECTION-BASED MANAGEMENT FUNCTION

BACKGROUND OF THE INVENTION

1. Field of the Invention

The present invention relates generally to image forming apparatuses, and more particularly to an image forming apparatus having a section-based management function of limiting prints more than a printable number based on preset reservation conditions.

2. Description of the Related Art

In the field of conventional multi-job printing machines, Japanese Patent Publication No. 5-66585 (Japanese Patent Laying-Open No. 60-218668) for example discloses a technique according to which if the total of the number of bins necessary for a new job at the time of reserving the job plus the number of bins necessary for already reserved jobs exceeds the number of bins available, the already printed number is sequentially decremented from the remaining number counter which stores the printable number, the printing operation is stopped if the remaining number counter indicates 0, and the user is warned of the state.

In such a conventional copying machine as described above, the counter value of the remaining number counter is sequentially decremented by the printed number by an actual copying operation, which is stopped if the remaining counter is 0, and therefore a new job cannot be started at that point.

SUMMARY OF THE INVENTION

It is therefore an object of the invention to provide an image forming apparatus capable of warning a user of that a set printing number exceeds a printable number at the time of reserving one job.

Another object of the invention is to provide an image forming apparatus capable of automatically changing a set printing number exceeding a printable number into the printable number, thereby preventing mistakes in setting a printing number.

An image forming apparatus according to the invention includes a device to make prints in a print queue containing a plurality of print jobs, a first memory for storing a print queue containing the plurality of print jobs, a second memory for storing a maximum number of prints, an input device for inputting a print job into the first memory, a calculator for calculating a capacity number which is generated from the maximum number in the stored print queue, a comparator for comparing the capacity number with the input number, and an alarm for alarming in response to a comparing result of the comparator.

In the above configuration, if a print number is set exceeding the maximum print number stored in the first and second memories, a user can be warned of that a print number more than the maximum capacity number is input at the time of setting the print number, the printing operation of already set prints is not interrupted, and the user can be notified of whether or not a copying operation can be normally completed at the time of setting the number of prints, thus improving the operability.

In another aspect of the invention, an image forming apparatus includes a device to make prints in a print queue containing a plurality of print jobs, a first memory for storing the print queue containing the plurality of print jobs, a second memory for storing the maximum number of prints, an input job for inputting a print job into the first memory, a calculator for calculating a capacity number which is generated from the maximum number and the stored print queue, a comparator for comparing the capacity number with the input number, and a changing device for changing stored print queue containing the plurality of print jobs when the input number is larger than the capacity number.

In this configuration, if a print number exceeding the maximum number of prints previously set in the first and second memories is input, the input number of prints can automatically be changed into a printable number, the apparatus is not stopped during a printing operation, and the printing operation can be executed more smoothly, thus improving the operability of the apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
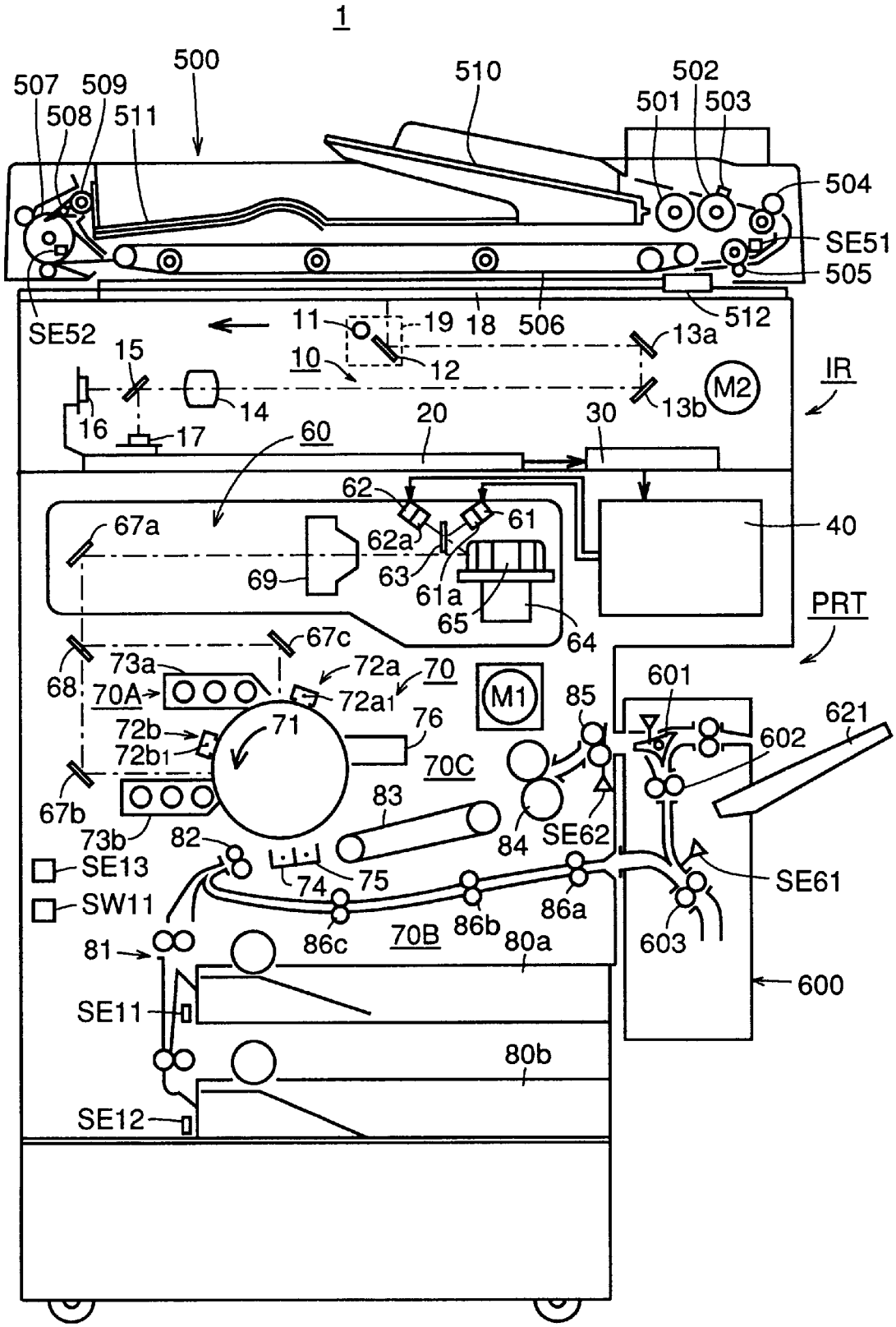
FIG. 1 is a cross sectional view showing the entire configuration of a copying machine according to one embodiment of the invention.
Figure 2:
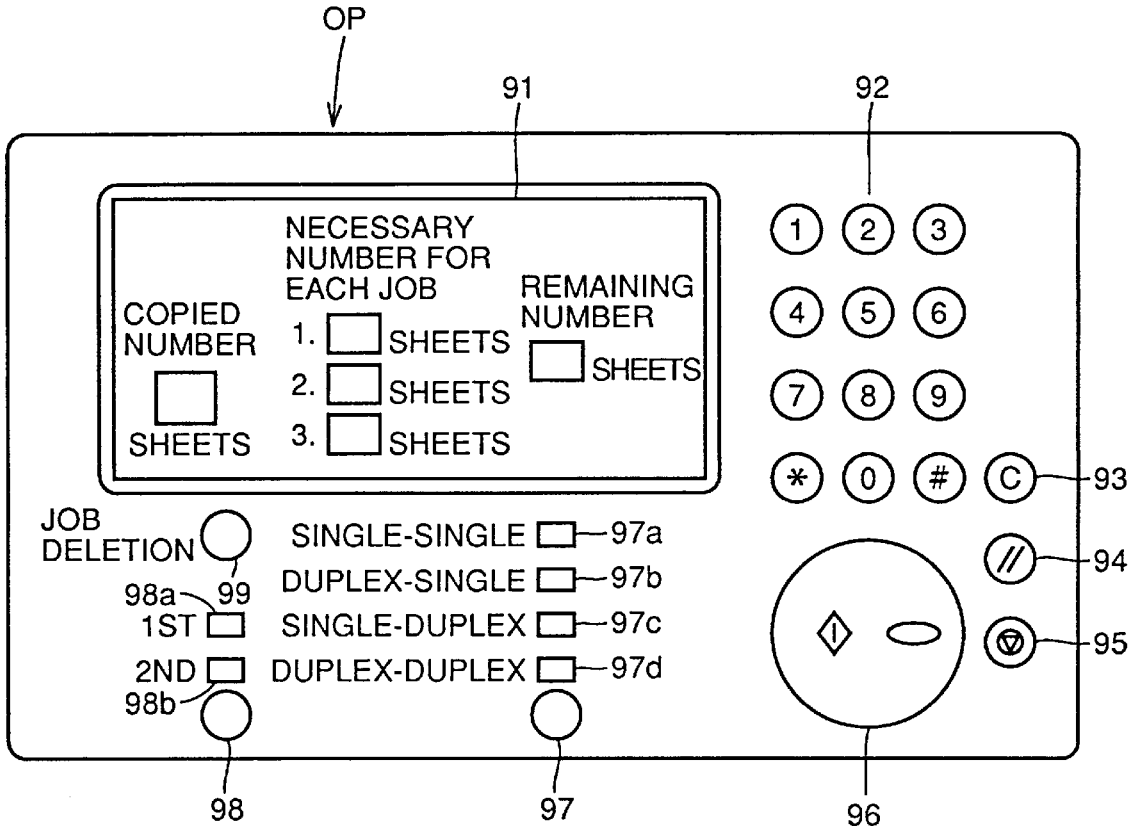
FIG. 2 is a front view showing an operation panel.

FIG. 1 is a cross sectional view showing the entire configuration of a copying machine 1 according to one embodiment of the invention, and FIG. 2 is a front view showing an operation panel OP in a cross section.

In these figures, copying machine 1 includes a scanning system 10 for reading a document and changing the read document into an image signal; an image signal processing portion 20 for processing the image signal input from scanning system 10; a memory unit portion 30 switching between directly outputting image data input from image signal processing portion 20 to a printer device PRT or storing the input image data in a memory; a printing processing portion 40 for driving two semiconductor lasers 61 and 62 based on the image data input from memory unit portion 30; an optical system 60 for directing two laser beams from semiconductor lasers 61 and 62 into exposure positions different from each other; a photoreceptor drum 71; an image forming system 70 for developing a latent image formed by exposure with light for transfer onto a paper sheet and forming an image by fixation; an operation panel OP provided on a top of the main body; a document transfer portion 500 for transferring a document and turning it over if necessary; and a paper re-feed portion 600 for feeding a sheet once again to the transfer position.

Note that scanning system 10, image signal processing portion 20 and the like constitute a reading device IR and print processing portion 40, optical system 60, image forming system 70 and the like constitute a printer device PLT.

Scanning system 10 includes an exposure lamp 11 and a first mirror 12 assembled in a scanner 19 moving under a platen glass 18, second and third mirrors 13*a*, 13*b*, a light collecting lens 14, a dichroic mirror 15, photo-electric conversion elements 16 and 17 using a CCD array or the like, and a scan motor M2.

Dichroic mirror 15 reflects light of a specified color such as red among light reflected from a document and passes light of a complementary color to the specified color. Photo-electric conversion elements 16 and 17 convert an image in a non-specified color, mainly black in the document and an image in the specified color (red) individually into electrical signals.

Image signal processing portion 20 processes the image signals output from these two photo-electric conversion elements 16 and 17, identifies each pixel in the document image as those in a specified color (second color) and the other colors (first color) and outputs respective image data with color data to memory unit portion 30. Memory unit portion 30 will be detailed later.

Printing processing portion 40 directs these pieces of image data with color data to two semiconductor lasers 61 and 62, at which time image data to be applied to one semiconductor laser 62 is delayed based on the difference between the exposure positions corresponding to the two semiconductor lasers 61 and 62.

Optical system 60 includes semiconductor lasers 61 and 62, a dichroic mirror 63 for composing two laser beams, a polygon mirror 65 for deflecting a composite laser beam, a main lens 69, a reflection mirror 67*a*, a dichroic mirror 68 for separating the composite laser beam into the original two laser beams, and reflection mirrors 67*b* and 67*c*.

Image forming system 70 includes a development transfer system 70A, a transfer system 70B, and a fixation system 70C.

Development transfer system 70A includes a photoreceptor drum 71 driven to rotate anticlockwise in FIG. 1, sequentially from the upstream of the rotating direction around the drum, a first corona charger 72*a*, a first developer 73*a*, a second corona charger 72*b*, a second developer 73*b*, a transfer charger 74, a separation charger 75, and a cleaning portion 76.

First developer 73*a* stores a two-component developing agent of a red toner and a carrier corresponding to the second color, and second developer 73*b* stores a two-component developing agent of a black toner and a carrier corresponding to the first color.

Transfer system 70B includes cassettes 80*a* and 80*b* for storing paper sheets, size detection sensors SE11 and SE12 for detecting the size of paper sheets, a paper guide 81, a timing roller 82, a transfer belt 83, and horizontal transfer rollers 86*a* to 86*c* for transferring a sheet input from paper re-feed portion 600.

Fixation system 70C includes a fixation roller 84, a discharge roller 85, and a discharge sensor SE64 for detecting discharge of a sheet.

Paper re-feed portion 600 is of a circulation type according to which a sheet discharged from discharge roller 85 is once stored, turned over in a duplex printing mode, or not turned over in a composite mode, and transferred into horizontal transfer roller 86*a* in transfer system 70 in order to print an image again.

Paper re-feed portion 600 includes a switching nail 601 for switching between discharge onto discharge tray 621 and refeeding, a transfer roller 602, an inversion roller 603 and an inversion sensor SE61.

In the duplex printing mode, the left end portion of switching nail 601 moves upwardly by the function of a solenoid not shown, thus a sheet discharged from discharge roller 85 is guided toward transfer roller 602, through which the sheet reaches inversion roller 603.

Once the tail end of the sheet reaches inversion sensor SE61, inversion roller 603 is inverted to transfer the sheet toward horizontal transfer roller 86*a*, and the sheet reaches timing roller 82 through horizontal transfer rollers 86*b* and 86*c*, and stands by thereupon. At the time, the following sheets are sequentially transferred at prescribed intervals, and therefore the number of half-side printed sheets which can stand by depends on the length of the sheet provided that image data is not delayed.

Document transfer portion 500 automatically transfers a document set on document feed tray 510 onto platen glass 18, and discharges the document having read by scanner 19 to a document discharge portion 511.

Document transfer portion 500 includes a feed roller 501, a handling roller 502, a handling pad 503, an intermediate roller 504, a resist roller 505, a transfer belt 506, an inversion roller 507, a switching nail 508, a discharge roller 509, feed tray 510, discharge tray 511, a document scale 512, a feed sensor SE51 and a discharge sensor SE52.

Document transfer portion 500 operates differently between document reading modes. The modes include a scan mode in which a document is read by the scanning operation of scanner 19, and a moving mode in which a document is read during transfer with scanner 19 being stopped.

Therefore, the operation of document transfer portion 500 includes operations in a scan single side mode (sometimes simply referred to as "single mode"), a moving single side mode, and a moving duplex printing mode depending upon if only one side of the document is read or both sides are read.

In the single mode, one or more sheets of document are set on feed tray 510 with a side to be read facing upward. As the operation starts the document sheets are sequentially transferred by feed roller 501 starting from the sheet at the bottom, and handled by handling roller 502 and handling pad 503. Thus handled document sheets are passed through intermediate roller 504, straightened by resist roller 505 if the edges are not straight, and transferred onto platen glass 18 by the function of transfer belt 506. Then immediately after the tail end of the document sheet is passed through the left end of document scale 512, transfer belt 506 slightly rotates reversely to stop.

Thus, the right end (tail end) of a document sheet hits upon the edge of document scale 512, and the document sheet is positioned accurately on platen glass 18. At the time the tip end of the next document sheet has already reached resist roller 505, so that the time required for transferring the next document sheet is reduced.

In the state, scanner 19 scans the front surface (bottom surface) of the document sheet for reading. When the document reading completes, the document sheet is transferred leftward by transfer belt 506, U-turned by inversion roller 507, passed over switching nail 508 and discharged onto discharge tray 511 by the function of discharge roller 509. At the time, the document sheet is discharged with its reading surface (front surface) facing upward.

Now, the moving single side mode will be described. The moving single side mode permits a single copying for example, and operates in connection with scanning system 10.

More specifically, the operation is the same as the above-described single mode as far as a document sheet passes through resist roller 505, but thereafter the document sheet is transferred at a constant speed corresponding to a printing magnification by transfer belt 506, and passed through inversion roller 507 to be directly discharged onto discharge tray 511. During the period, scanner 19 stops at the right end of platen glass 18 over which the document sheet passes, and thus the front surface of the document sheet being transferred is read.

The reading is therefore executed at a high speed, because the reverse positioning of a document sheet as the single mode or the operation of scanning and returning by scanner 19 is not conducted.

Now, the moving duplex printing mode will be described. In the moving duplex printing mode, the operation is the same as the moving single side mode as far as the reading of the surface of a document sheet, but during the operation until then, switching nail 508 is switched to have its left end faced upward, and the document sheet having its front surface read in the process of transfer is U-turned by inversion roller 507, then passed under switching nail 508, and guided once again under transfer belt 506 with its front and back being reversed.

During the period, scanner 19 moves leftward at the point the front surface of the document sheet is read, and stands by at the back surface reading position according to the length of the document sheet. At the back surface reading position, which is slightly leftward from the position where the tip end and tail end of a document sheet match as the document sheet is U-turned by inversion roller 507, in other words, the moving distance of the document around inversion roller 507 matches the length of the document sheet.

Therefore, at the back surface reading position, depending upon the length of the document sheet, if the document sheet is too short for its tip end and tail end to match on the top surface of platen glass 18, the left end of the platen glass 18 becomes the back surface reading position. Note that the length of the document sheet is detected by feed sensor SE 51 during the transfer of the document sheet.

Now, the document sheet once again guided under transfer belt 506 is transferred rightward at a constant speed according to a printing magnification by the function of reverse transfer belt 506, passes over scanner 19 standing by at the back surface reading position during the transfer, and therefore the back surface of the document sheet being transferred is read.

At the point at which the reading of the back surface of the document sheet completes, transfer belt 506 is turned reversely to transfer the document sheet leftward, the document sheet is inverted by inversion roller 507, again guided under transfer belt 506, and transferred rightward and its left end reaches transfer belt 506. Thereafter, the document sheet is again transferred leftward this time, passes over inversion roller 507 and switching nail 508 switched and discharged onto discharge tray 511 by discharge roller 509. Thus, the document sheet is discharged with its front surface facing upward.

Now, a brief description follows on a copying machine 1*a* having document reading portions 10*a* and 10*b* dedicated to the front end back surfaces of a document sheet, respectively, as opposed to the above-described scanning system 10 in copying machine 1.

Figure 3:
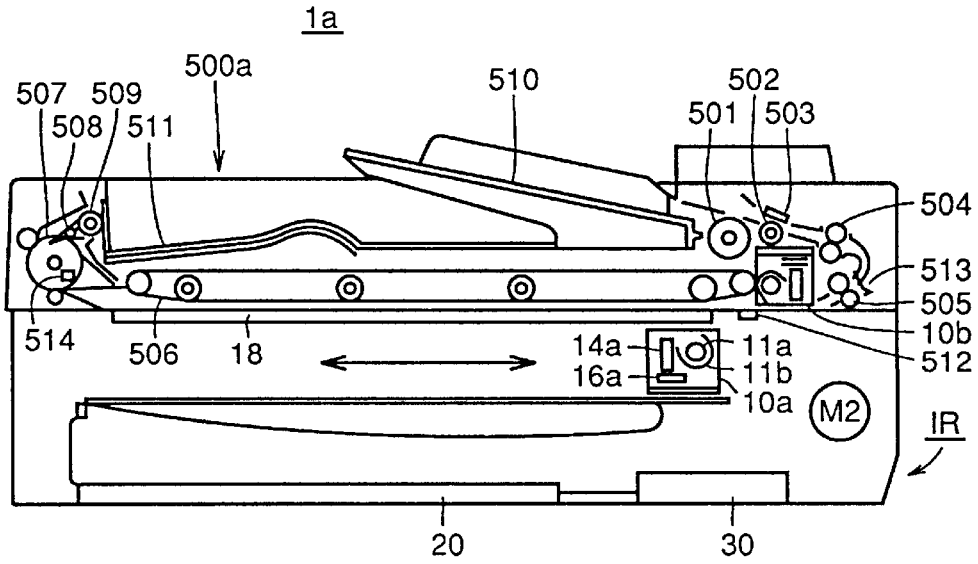
FIG. 3 is a cross sectional view showing an essential portion of a copying machine according to another embodiment.

FIG. 3 is a cross sectional view showing an essential portion of copying machine 1*a* according to another embodiment of the invention. In copying machine 1*a*, document reading portions 10*a* and 10*b* each include an exposure lamp 11*a* for illuminating a document sheet, a lamp guide 11*b*, SELFOC lens array 14*a*, and a photo-electric conversion element 16*a* formed of a close-contact CCD image sensor.

One document reading portion 10*a* which reads a front surface of a document is capable of scanning the surface under platen glass 18. The other document reading portion 10*b* which reads a back surface of a document is arranged in a fixed manner immediately following resist roller 505 in document transfer portion 500*a*.

In a moving single surface mode by copying machine 1*a*, a document is transferred for reading over document reading portion 10*a* standing by at the position of scanner 19 as in the case of the moving single surface mode by copying machine 1 described above.

In a scan single surface mode, after a document is transferred onto platen glass 18 and positioned, document reading portion 10*a* makes a leftwise scanning for reading a surface of the document.

In a moving duplex mode, first, immediately after passage of a document through resist roller 505, a back surface of the document is read by document reading portion 10*b*, followed by the same operation as the scan single surface mode for reading the front surface by document reading portion 10*a*.

As described above, in the case of reading both surfaces of a document, document reading portions 10*a* and 10*b* operate in time series, and therefore image signals from respective photo-electric conversion elements 16*a* need only be switched by switching circuitry for output, which requires only one system of processing circuitry for image signal processing portion 20.

Referring back to FIG. 2, operation panel OP includes a ten key 92 for inputting the number of prints or magnifications, a clear key 93 for returning the number to standard value "1", a panel reset key 94 for returning values set in copying machine 1 to standard values, a stop key 95 for interrupting a copying operation, a start key 96 for initiating a copying operation, a mode set key 97 for setting a copy mode which is an operation mode for setting duplex copying or kinds of sheets to be fed, mode display portions 97*a* to 97*d* displaying a copy mode, paper sheet inlet select key 98 for selecting the kind of sheet, a paper sheet inlet display portions 98*a~b* displaying a selected paper sheet inlet, and a job delete key 99 for changing the display into a job delete display in order to delete a presently reserved job.

A liquid crystal touch panel 91 displays other various kinds of information including various states of copying machine 1 such as jam, servicing call, and paper empty, and various operation modes of copying machine 1 such as exposure level, magnifications, and kinds of sheets, and the panel is also used to input a selection of an operation mode.

Figure 4:
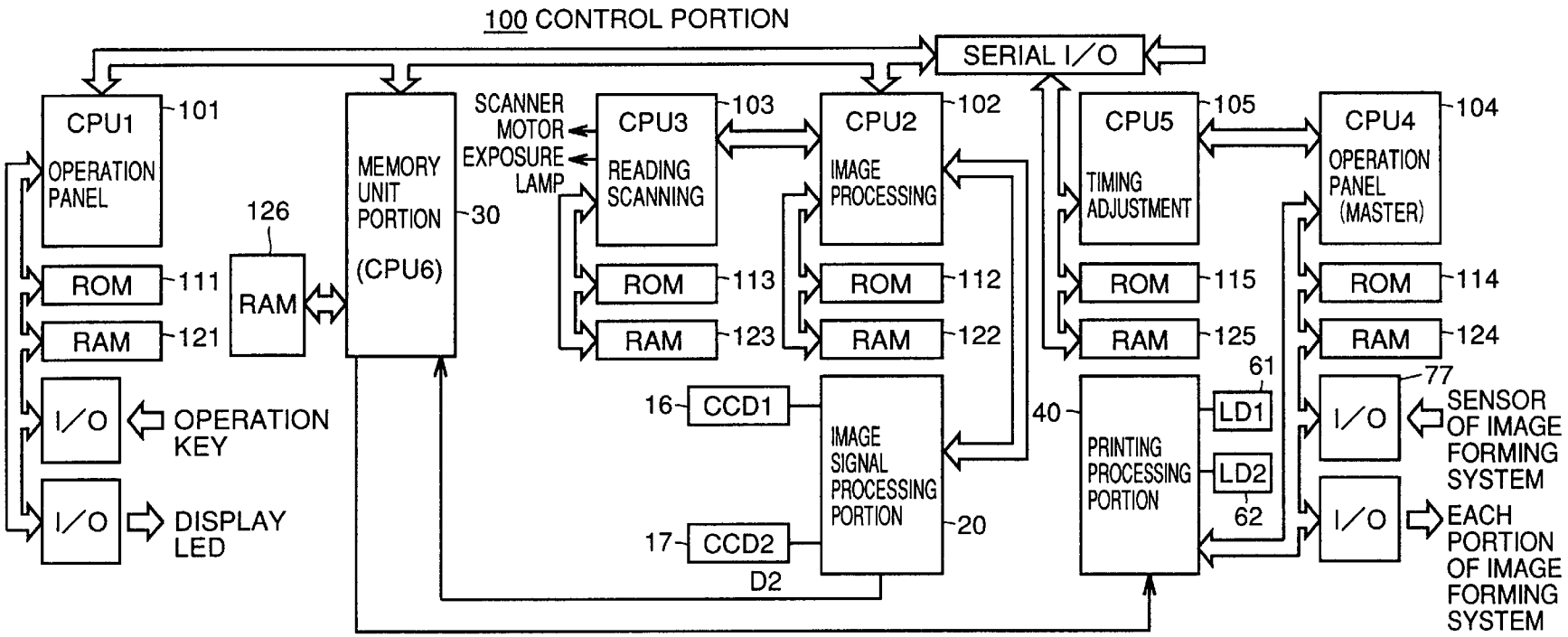
FIG. 4 is a first block diagram showing the configuration of a control portion in a copying machine.
Figure 5:
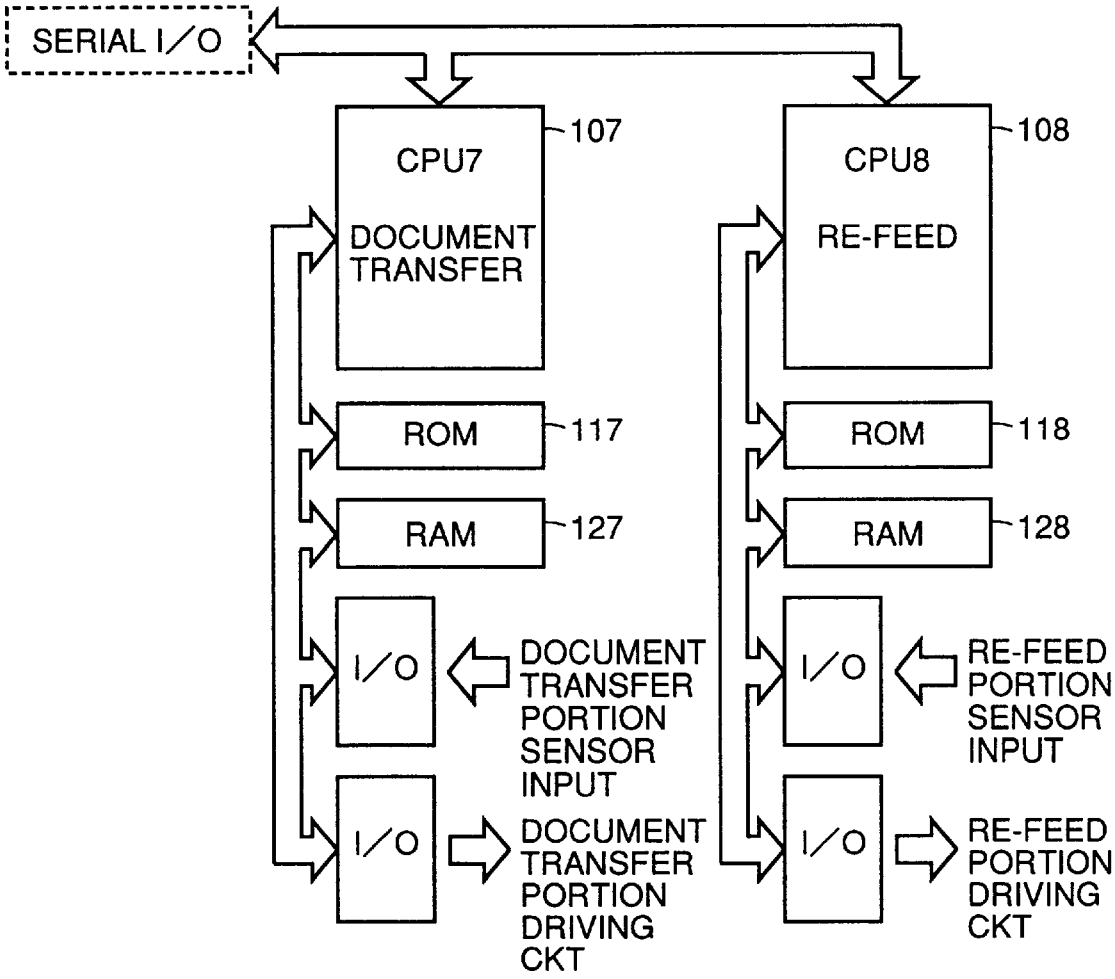
FIG. 5 is a second block diagram showing the configuration of a control portion in a copying machine.

Now, control portion 100 will be described. FIGS. 4 and 5 are block diagrams both showing the configuration of control portion 100 in copying machine 1.

Control portion 100 is mainly formed of eight CPUs 101 to 108, which are provided with ROMs 111 to 118 each storing a program, and RAMs 121 to 128 which will be a working area for executing a program. Note that CPU 106 is provided in memory unit portion 30 (see FIG. 6).

CPU 101 performs control related to input of a signal and display using various operation keys in operation panel OP. CPU 102 controls each portion of image signal processing portion 20, while CPU 103 controls driving of scanning system 10. CPU 104 controls print processing portion 40, optical system 60, and image forming system 70, while CPU 105 performs processings related to overall timing adjustment for control portion 100 and setting operation modes.

CPU 106 controls memory unit portion 30 and stores read image data in a memory (image memory 304), and reads out the data for output to print processing portion 40. Thus, reading device IR and printer device PRT are independently controlled for the purpose of improving the copying speed, which will be detailed later.

CPU 107 controls document transfer portion 500, and CPU 108 controls sheet re-feed portion 600. Among these CPUs 101 to 108, serial communication is made by interruption, and commands, reports, and other data are transmitted/received.

Now, each processing portion for processing image data will be described. Image signal processing portion 20 includes an A/D converter, a shading correction portion, a color determination portion for determining colors of pixels in a document based on image data, and a picture quality correction portion.

Image signal processing portion 20 quantitizes image signals input from photoelectric conversion elements 16 and 17 on a pixel-basis into 8-bit image data, which is subjected to various processings for output as image data D2. 1-bit color data DC indicating whether or not each pixel of image data D2 is in a specified color is output as well.

Figure 6:
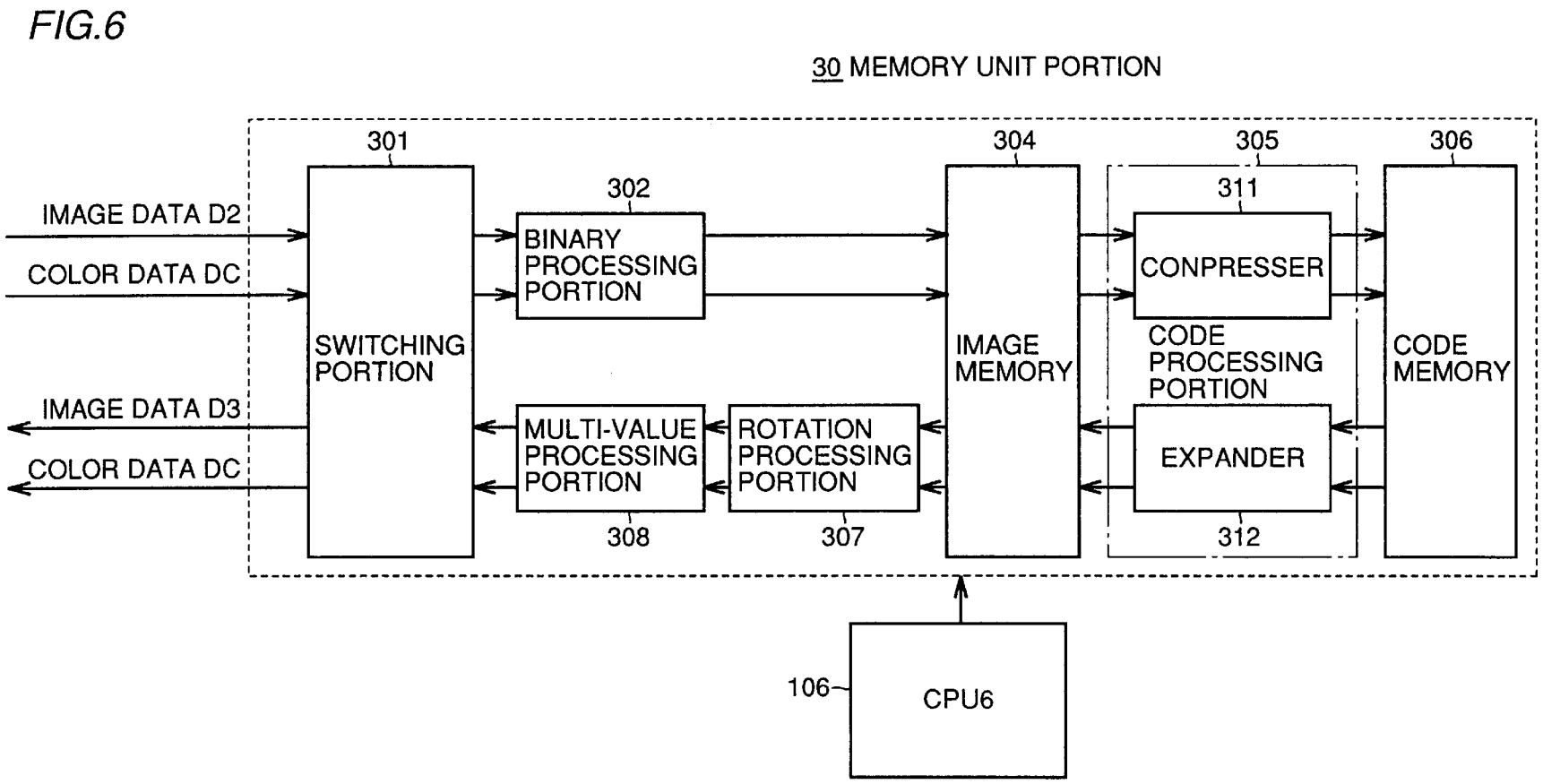
FIG. 6 is a block diagram showing a memory unit portion.

Now, memory unit portion 30 will be described. FIG. 6 is a block diagram showing memory unit portion 30. Memory unit portion 30 includes a switching portion 301, a binary processing portion 302 for producing binary data based on set parameters from CPU 106, a multi-port image memory 304 having a capacity for two pages in A4 size for 400 dpi, a code processing portion 305 having a compressor 311 and an expander 312 operable independently from each other, a code memory 306 having a plurality of ports, a multi-value processing portion 308 for producing a multi-valued data based on set parameters from a CPU 106, and CPU 106 controlling the entire portion.

Now, the operation of copying machine 1 will be described in conjunction with flow charts. Main routines executed by CPUs 101 to 108 will be described, followed by a description of subroutines executed in each main routine.

Figure 7:
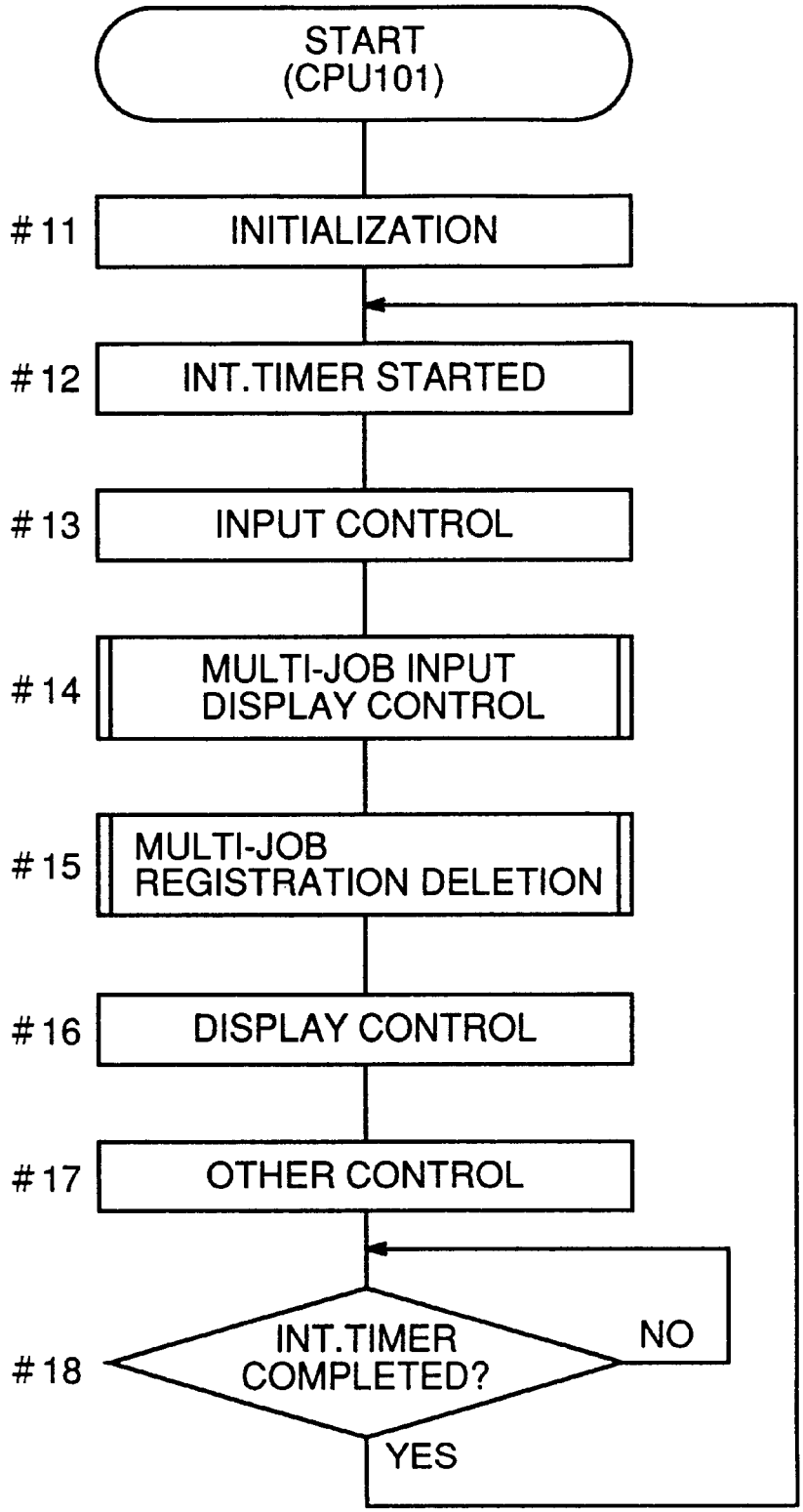
FIG. 7 is a flow chart for use in illustration of a main routine by a CPU 101.

FIG. 7 is a flow chart showing the main routine of CPU 101. After initialization (step #11, hereinafter "step" will be omitted), an internal timer is started to monitor so that time for a routine is constant (#12, #18), to operation panel OP is input with processings such as input control, multi-job input display control, multi-job registration cancellation and display control (#13 to #16), followed by other processings (#17). Note that communication is made with other CPUs 102 to 108 by an interruption processing.

Figure 8:
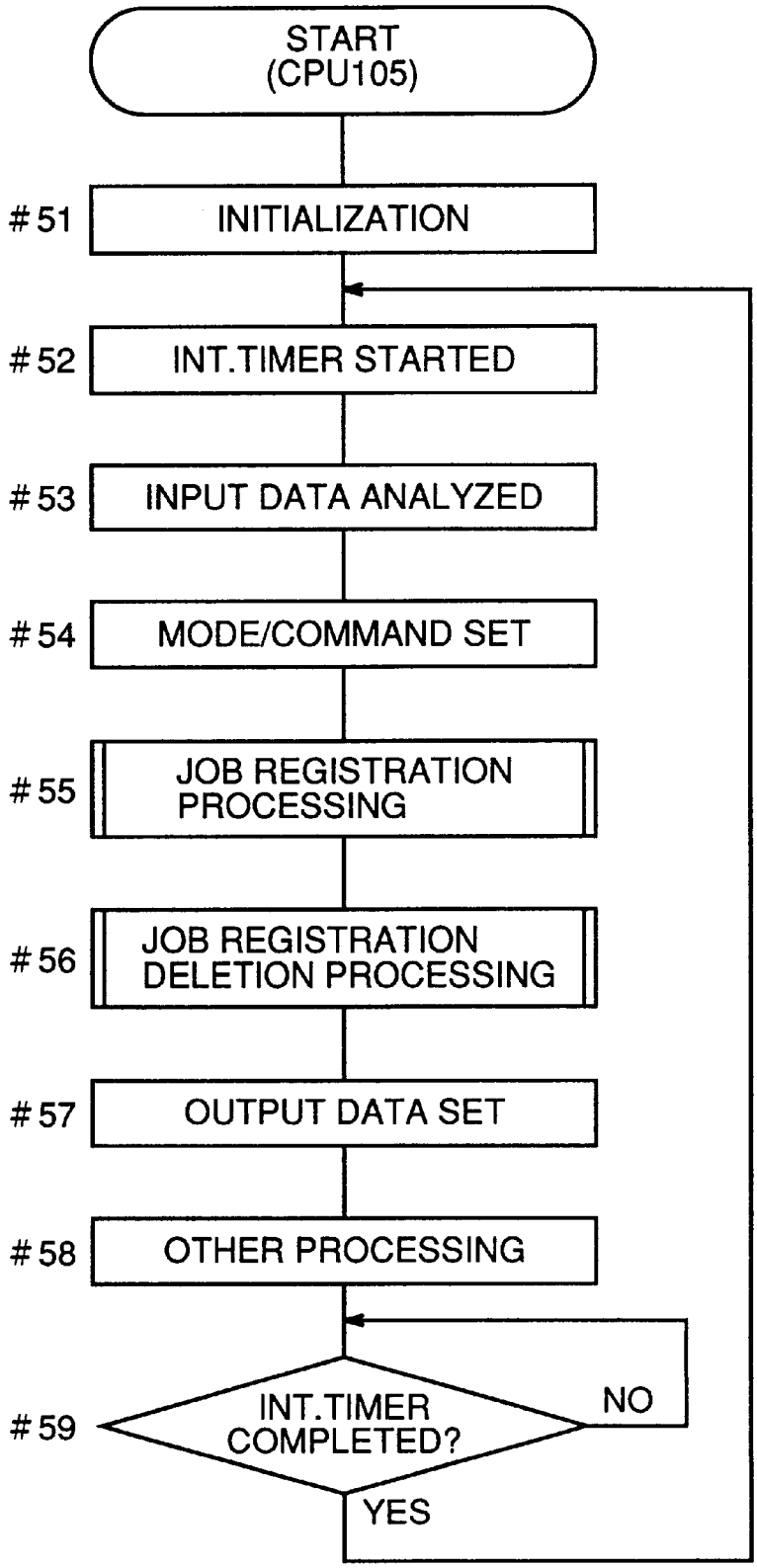
FIG. 8 is a flow chart for use in illustration of a main routine by a CPU 105.

FIG. 8 is a flow chart showing the main routine of CPU 105. CPU 105 executes activation, and setting of a stop command and an operation mode to other CPUs, thereby controlling the entire copying machine 1. After data input through communication by means of interruption is checked, the content is analyzed (#53). If there is a portion to be operated or the magnification has been changed based on the content, a mode/command setting processing is executed for newly setting an active command or mode data for magnification (#54), a job registration processing (#55) and a job registration deletion processing (#56) are executed, and the data is further set in an output area in order to output by means of communication.

Figure 9:
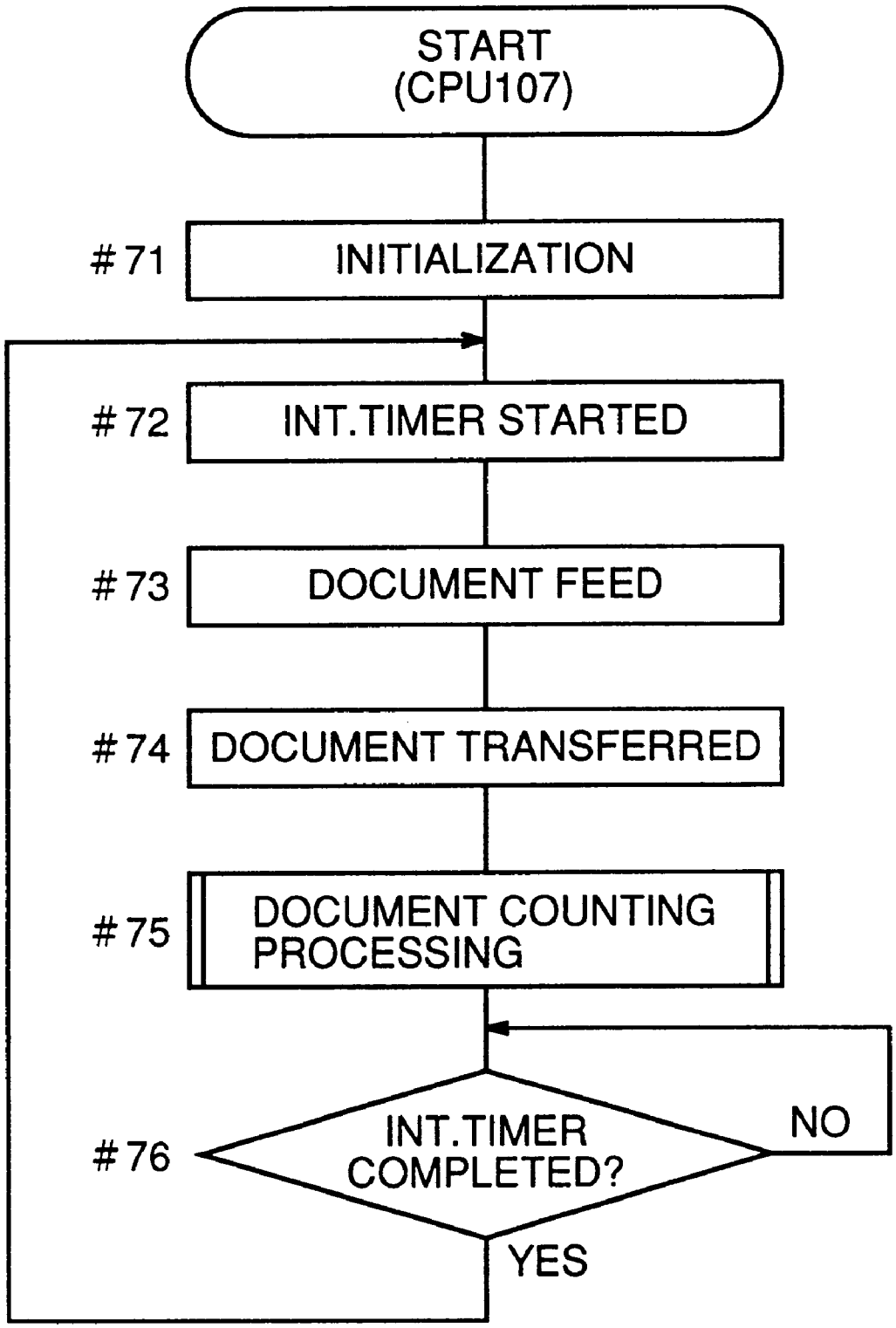
FIG. 9 is a flow chart for use in illustration of a main routine by a CPU 107.

FIG. 9 is a flow chart showing the main routine of CPU 107. CPU 107 controls document transfer portion 500. A document feeding processing for handling document sheets, correcting the edges straight and controlling transfer thereof until transfer belt 506 (#73), a document transfer processing for controlling positioning of the document onto a prescribed reading position by the function of transfer belt 506 and controlling transfer of the document until inversion roller 507 (#74), and a document counting processing for transmitting the number of set document sheets as the counting of all the document sheet set in the document count mode completes is conducted (#75).

Figure 10:
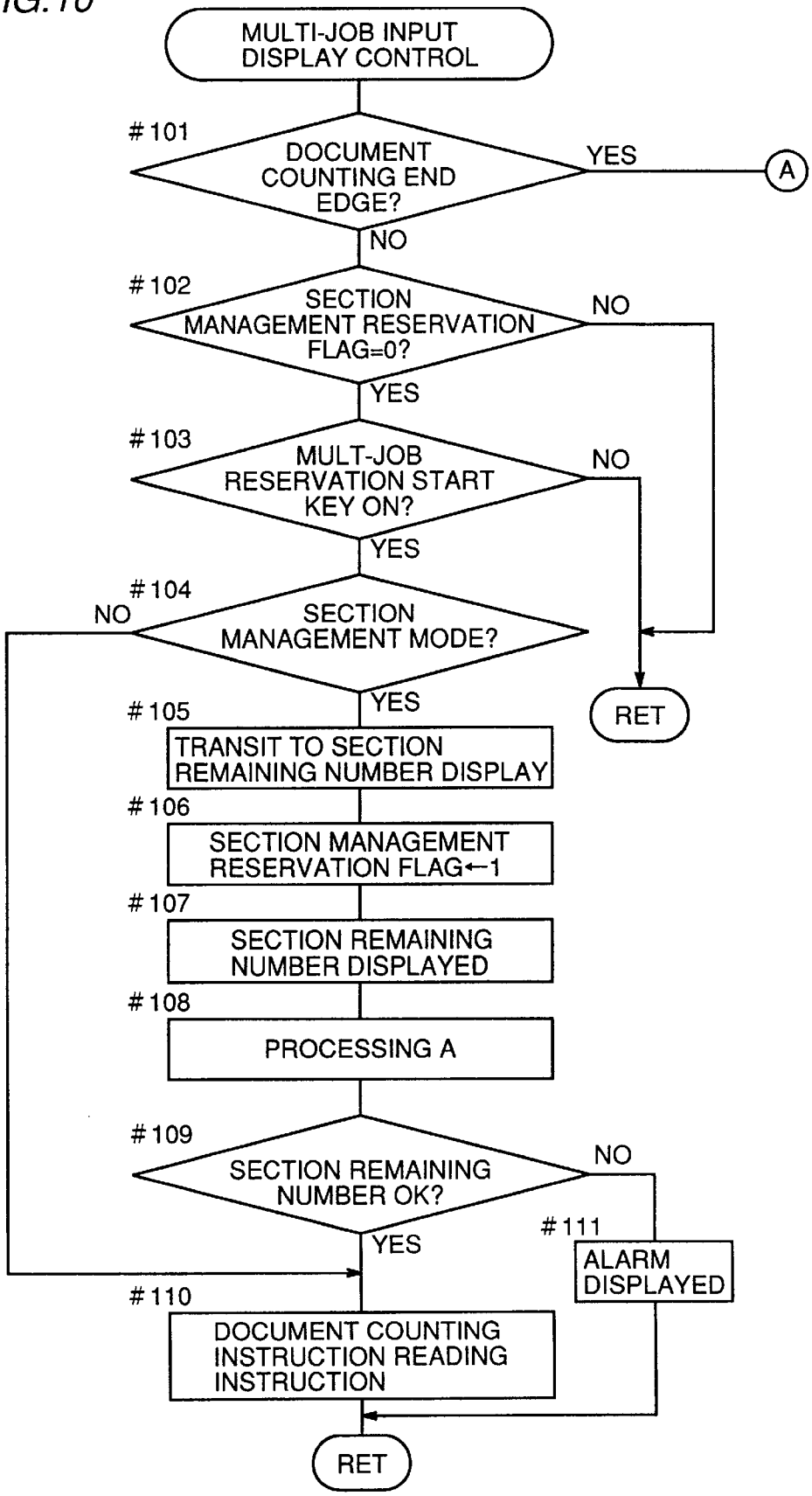
FIG. 10 is a flow chart showing a part of a multi-job input display control processing.
Figure 11:
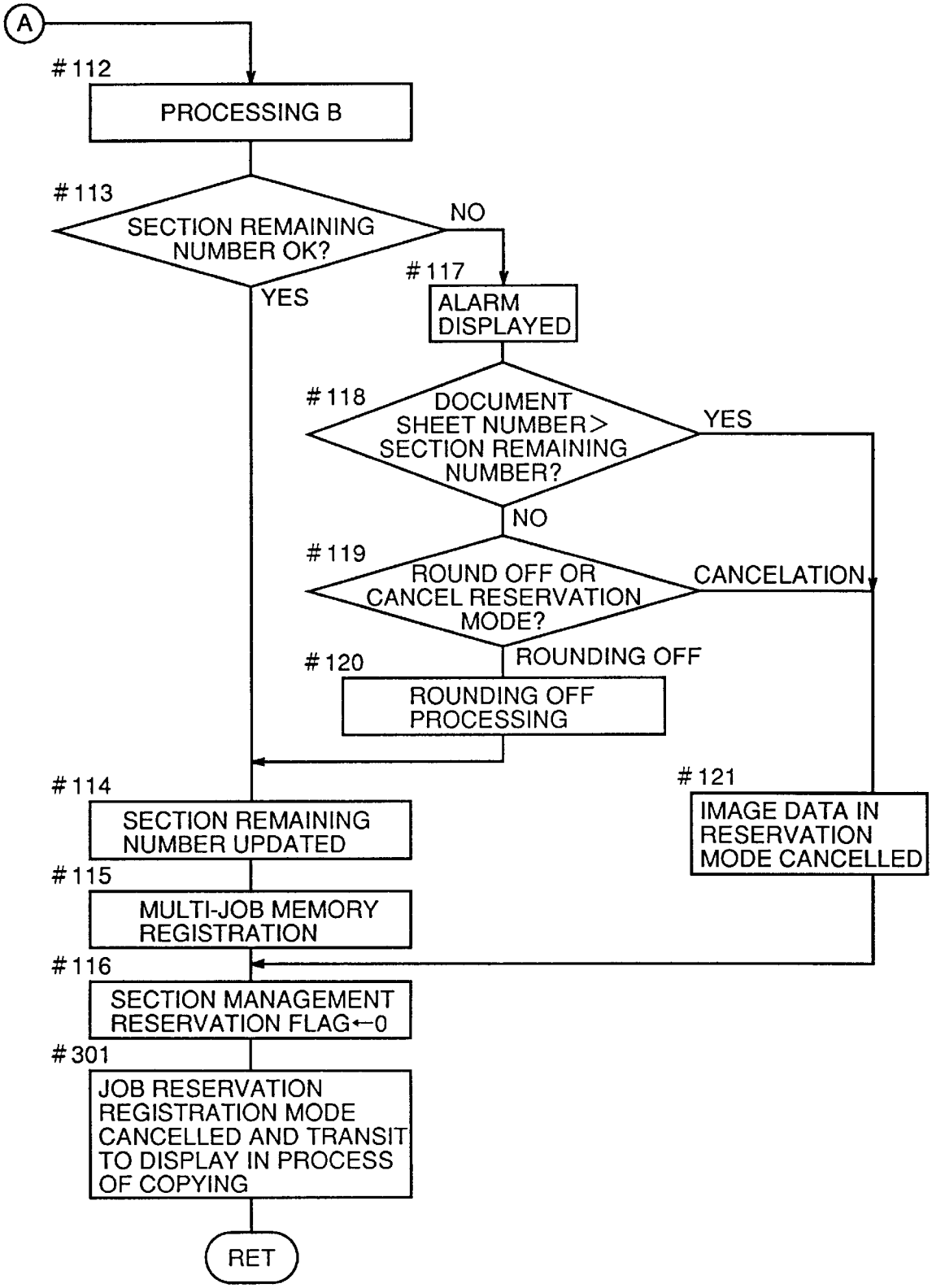
FIG. 11 is a flow chart showing another part of the multi-job input display control processing.

Now, the multi-job input display control processing (#14) and multi-job registration depletion processing (#15) in FIG. 7 will be further described. FIGS. 10 and 11 are flow charts for showing the multi-job input display control processing.

Referring to FIG. 10, the end edge of the document counting is determined by CPU 107 (#101), if the end edge is detected, the processing proceeds to #112. If no such edge is detected, it is determined if a section management reservation flag indicates 0 (#102), the processing proceeds to #103 if the flag indicates 0, and the processing completes otherwise.

Now, if the section management reservation flag indicates 0, it is determined if the multi-job reservation start key is pressed (#103), if the key is turned on, the processing proceeds to #104, and the processing completes otherwise. Now, if the multi-job reservation start key is turned on, it is determined if it is in the section management mode (#104), and if it is in the section management mode, the processing proceeds to #105 and to #110 otherwise.

In the section management mode, the LCD display is changed into the section remaining number display (display in FIG. 2) (#105) followed by setting the section management reservation flag to 1 (#106). Then, a processing displaying the section remaining number for the set section is made (#106). Then, the necessary number of prints resulting from the set mode and the input number of prints (=input number of prints×copy mode: prints=the number of copying set: copy mode=weighting) is calculated as processing A (#108). Herein, the copy=weighting means that for an A3-size sheet, the weighting is defined as twice as much as the weighting of A4-size sheet, in other words it means "x2". Then, it is determined if the necessary number calculated by processing A exceeds the section remaining number (#109), if it does not exceed, CPU 107 is instructed to count and read the document (#110), and otherwise a warning display processing indicating that the necessary number by processing A exceeds the section remaining number or a processing for rejection input with the ten key is conducted (#111).

In the section management mode, ID codes are allocated to users, the upper limit of number of prints is set for each ID code, and printing is prohibited once the set number is exceeded, in order to manage the number of prints for every ID code in other words for every section.

In the section management mode, sections are in managed states. Usually the mode is selected by a service man, and the ID code should be input for copying.

Now, the section management mode will be described. In the section management mode, the number of prints is controlled for every section to which an operator belongs, and the total number of prints can be limited for one section.

More specifically, before the operator makes a print by the copying machine, he/she should input his/her section code (secret number) with the operation panel to be admitted copying.

Terms used in the specification mean as follows. The section upper limit number is the upper limit of total prints by the section, the section code indicates a secret number for each section, the section printed number means the number of prints made by the section, the section remaining number is the number calculated by (section upper limit number) minus (section printed number), in other words the remaining number of prints which can be made by the section, and the section management mode is a mode indicating whether or not the copying machine is presently in a setting managed by the section (which can be changed by a choice).

Note that the section management can be made for each copying machine, a management device may be used independently from the copying machine and for example a section card may be used. Therefore, in the preferred embodiments, the function of section management is introduced into the copying machine, but the section management function may be independently implemented by a management device and one or more copying machines may be managed. A plurality of sections may be allocated to a single copying machine or a single section may be allocated to a single copying machine.

At #104, in the case of the section management mode, a processing of inputting/displaying the section code is executed (#105). Then, the section management reservation flag is set to 1 (#106). A processing of displaying the section remaining number for the set section is executed (#107). As processing A, the necessary number of prints resulting from the set mode and the input number (=the input number×copy mode) is calculated (#108). It is determined whether or not the necessary number calculated according to processing A exceeds the section remaining number (#109), if it does not exceed CPU 107 is instructed to count the document sheets (#110), and otherwise a warning display processing notifying that the necessary number based on processing A exceeds the section remaining number or a processing for rejecting input of the ten key is executed (#111).

Referring to FIG. 11, in response to a signal indicating the completion of the document counting from CPU 107 (YES in #101), the number of jobs resulting from the input number, the copy mode and the number of document sheets (="processing A"×number of document=the input number× copy mode×the number of document) is calculated as processing B (#112). It is then determined if the number of jobs calculated by processing B exceeds the section remaining number of prints (#113), if the number does not exceed the operation proceeds to #114, and to #117 otherwise.

If the section remaining number is exceeded, a warning display processing for notifying that the number of jobs calculated by processing B exceeds the section remaining number, such as display of cancellation or rounding off is made as a reservation mode (#117). It is then determined whether or not the number of document exceeds the section remaining number (#118), if it is not exceeded, the operation proceeds to #119, and otherwise to #121, because the rounding off processing cannot be made.

If the number of documents does not exceed the section remaining number, it is determined which is selected between cancellation and rounding as the reservation mode (#119), if the rounding off processing is selected, the input number is rounded off (set less) so that the number of jobs calculated by processing B is within the number of the section remaining number (#120) and the operation proceeds to #114. Meanwhile, the cancellation processing is selected, a processing of canceling image data in the reservation mode is executed (#121), and the operation proceeds to #116.

Figure 16:
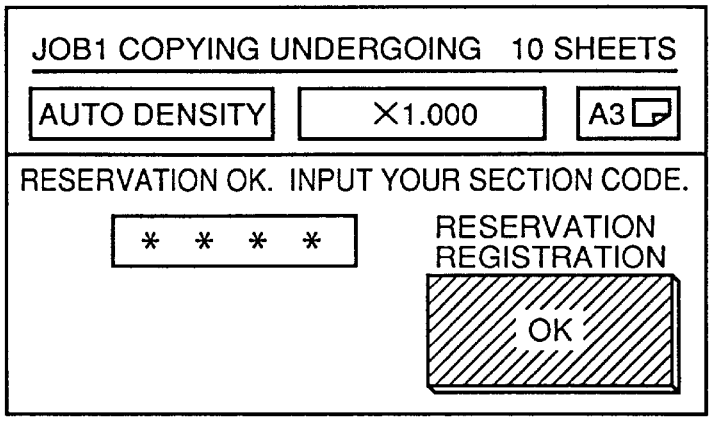
FIG. 16 is a view showing a display in a section-based management mode.

If the number of jobs calculated by processing B does not exceed the section remaining number, or the rounding off processing is executed, a processing of updating the section remaining number is executed (#114) followed by a processing of registering the set job in the memory (processing of transmitting a job memory registration request to CPU 105) (#115). Then, the section management reservation flag is reset (#116). Finally, the JOB reservation registration mode is canceled and the display returns to the one during copying operation (#301). Herein, if the display during copying is in the section management mode, the section input portion should be at the bottom of the display. There is provided a reservation registration key (FIG. 16).

Herein, the rounding off processing shown in FIG. 11 (#120) will be further described. The rounding off processing is to round off (set) the input number so that the number of jobs by processing B is within the section remaining number. If, for example, the input number is "6", the sheet at the sheet inlet is in A3, the number of document sheets is 20, and the section remaining number is 210, the following calculation holds:

The number resulting from processing A=6×2=12.

The number resulting from processing B=12×20=240.

Since 240>210, if the input number is rounded off to 5, for example, the following calculation holds:

The number resulting from processing A=5×2=10

The number resulting from processing B=10×20=200

Since 200<210, printing is enabled within the section remaining number.

Figure 12:
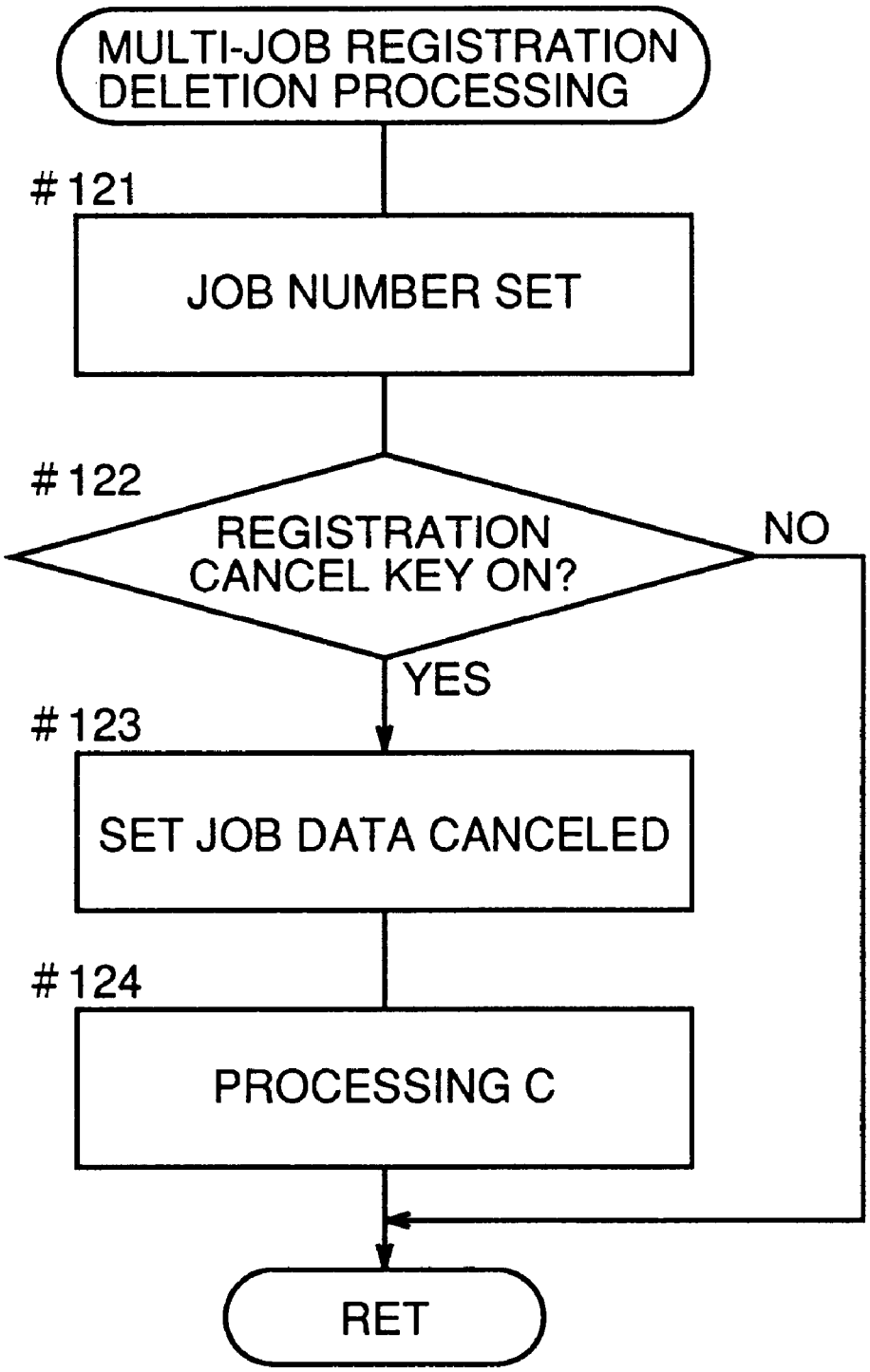
FIG. 12 is a flow chart for use in illustration of a job registration deletion processing.

Now, the multi-job registration deletion processing (#15) shown in FIG. 7 will be further described. FIG. 12 is a flow chart showing the multi-job registration deletion processing.

A job number to be deleted from registration is set (#121). It is determined if the registration cancellation key is turned on (#122). If the registration cancellation key is turned on, the processing proceeds to #123, and the processing completes otherwise.

If the registration cancellation key is turned on, a processing of canceling registration data for the registered job number (a processing of issuing a job memory registration deletion request to CPU 105) is executed (#123).

Then, the section remaining number resulting from the total number of the necessary job remaining number and already printed number are calculated as processing C (#124). More specifically, the section remaining number is once again calculated using the calculation formula: (section upper limit number)−{(section already printed number)+(the sum of the necessary number for each job for section after deletion.

Figure 13:
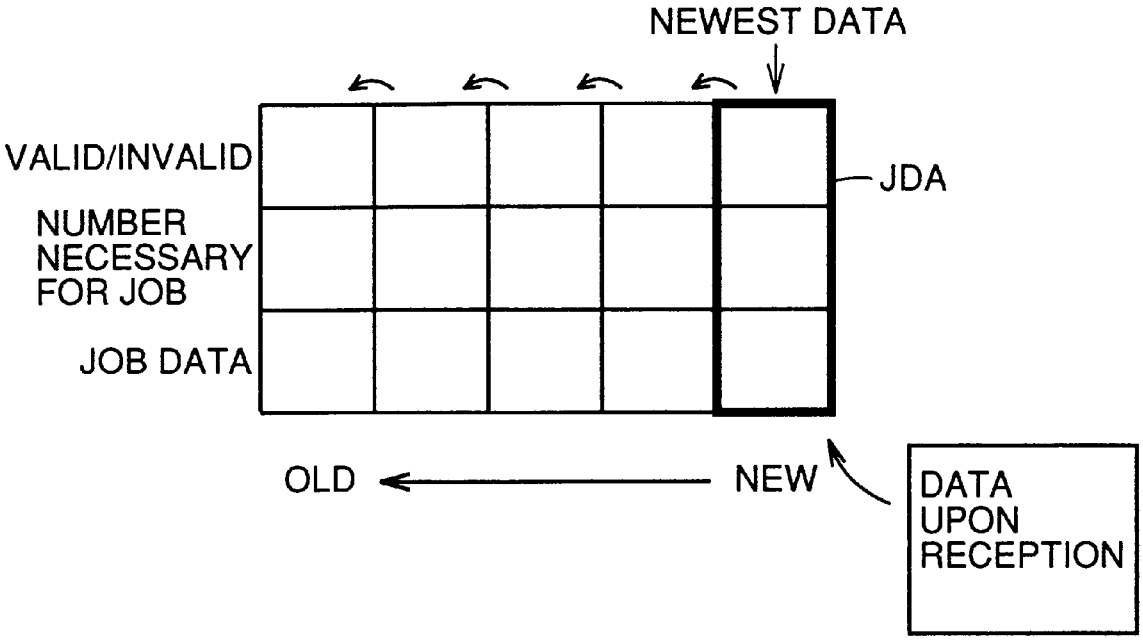
FIG. 13 is a diagram for use in illustration of a job registration processing.

The job registration processing (#55) shown in FIG. 8 will be further described. FIG. 13 shows in detail the job registration processing.

Referring to FIG. 13, upon receiving a job memory registration request from CPU 101, data in job data storage area JDA is shifted to an older area. Then, job data reserved upon reception and the necessary number of jobs are copied into the newest data area of job data storage area JDA, and the newest data area is validated. Finally, when one job completes, the oldest valid data in job data storage area JDA is eliminated.

Herein, data stored in job data storage area JDA includes valid/invalid data, job necessary number data, and job data. The valid/invalid data indicates if job data of interest and a job necessary number of interest are valid or invalid, the job necessary number data indicates the necessary number of prints for a job of interest, and the job data indicates data such as mode of a job of interest.

Now, the job registration deletion processing (#56) in FIG. 8 will be further described. In the job registration deletion processing, upon receiving a job memory registration deletion request from CPU 101, the data of a job number requested for deletion is changed from valid to invalid. The job memory registration deletion processing is transmitted by the processing in #123 shown in FIG. 12.

Figure 14:
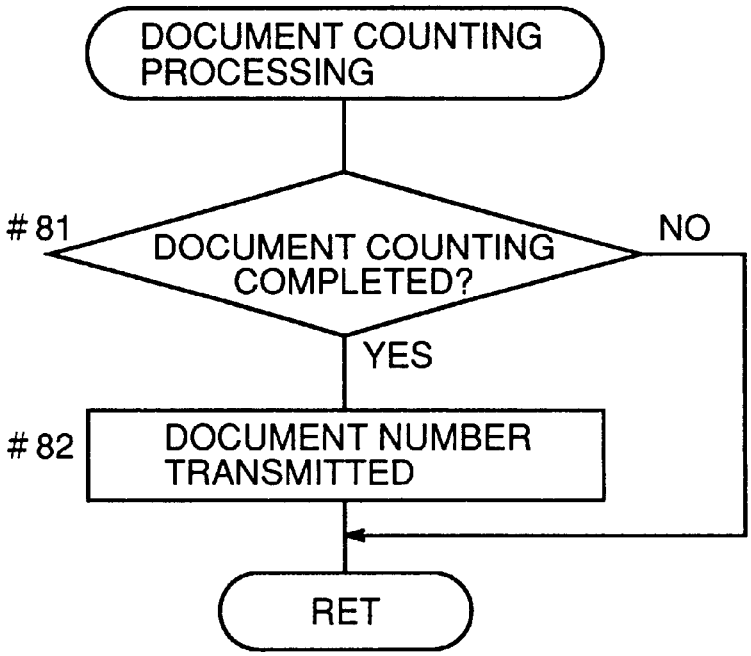
FIG. 14 is a flow chart for use in illustration of a document counting processing.

The document counting processing (#75) shown in FIG. 9 will be further described. FIG. 14 is a flow chart for use in illustration of the document counting processing.

Referring to FIG. 14, it is determined if counting of all the document sheets set in the document counting mode completes (#81), if the counting completes, the number of document sheets set is transmitted (#82), and the processing completes otherwise.

By the above-described processings, in the copying machine of the present embodiment the section remaining number and the number of prints necessary for a job can be compared upon setting a multi-job processing. It is determined if the job can be accepted or not upon setting. In the next multi-job processing reservation, the necessary number of prints for a set job is subtracted from the section remaining number upon the setting, and the result can be compared with the already updated section remaining number. As a result, a copying machine easier to handle can be provided, preventing such a situation in which a copying operation is stopped and the next job cannot be entered.

Figure 15:
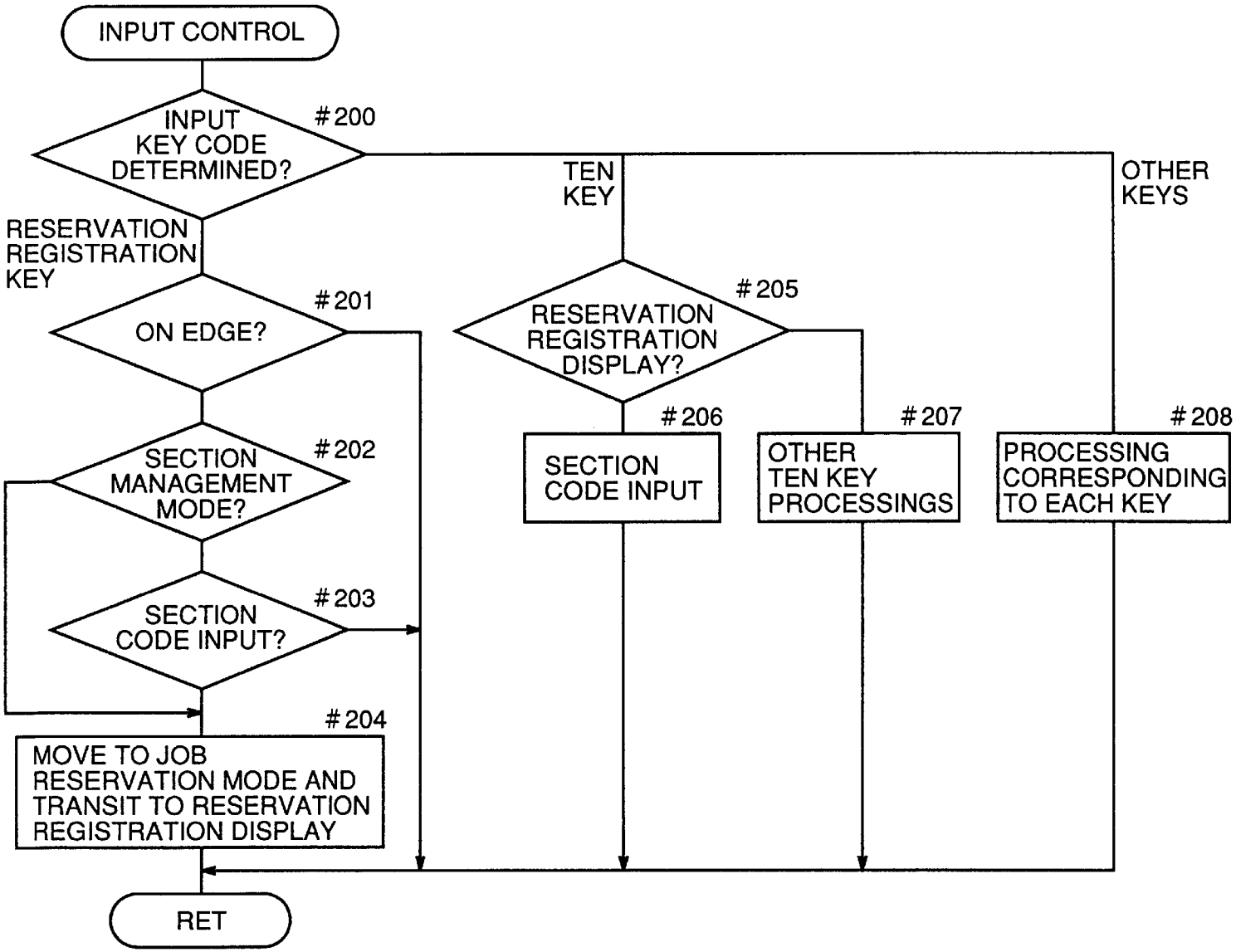
FIG. 15 is a flow chart for use in illustration of an input control in detail.
Figure 17:
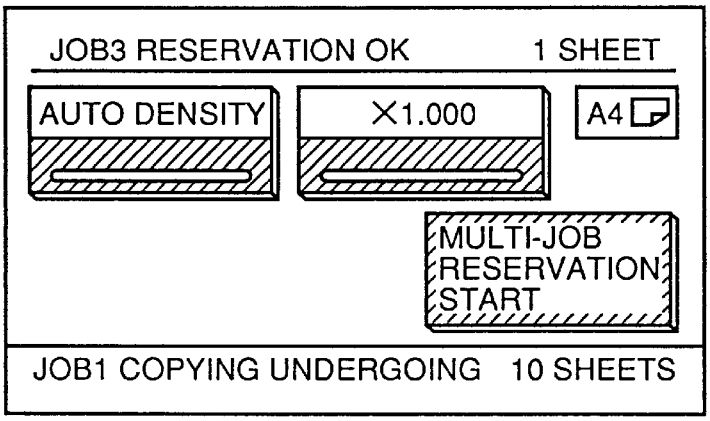
FIG. 17 is a view showing a display at the time of reservation registration.

Referring to FIG. 15, the input control (#13) in FIG. 7 will be described. In #200, the operation proceeds to a processing according to each key by an input key code. A touch key on the LCD determines which key on the display is pressed based on the present display number and the pressed coordinates, and produces a key code inherent to each key. If it is determined that the reservation registration key is turned on, for ON edge (#201) it is determined if the section management mode is entered (#202). In the section management mode, it is determined if a section code is input (#203). If the section code has been input, the JOB reservation registration mode is attained, and the operation proceeds to a reservation registration display (FIG. 17). If it is not in the section management mode, the determination in #203 is not executed, and the operation proceeds to #204. Then, if the key code corresponds to the ten key, and the display number is of the display during copying, the section code input processing is executed. If it is another display number a ten key input corresponding to the display is executed (#205 to #207). If the key code corresponds to a key other than the reservation registration key and the ten key, a processing corresponding to the key is executed in #208.

A display in each mode will be described.

FIG. 16 shows a display during copying in the section management mode. If a set document has been read, the display appears. A reservation registration for a job is executed using the reservation registration key within the display. In the section management mode, the reservation registration key also functions as an input completion key.

FIG. 17 shows a reservation registration display. If the reservation registration key in FIG. 16 is pressed, and the JOB reservation registration mode is attained, this display appears. The mode set in the reservation registration mode is registered upon completion of reading the document. Reading of the document and counting the number of document sheets are initiated in response to pressing of the multi-job reservation start key within the display.

Figure 18:
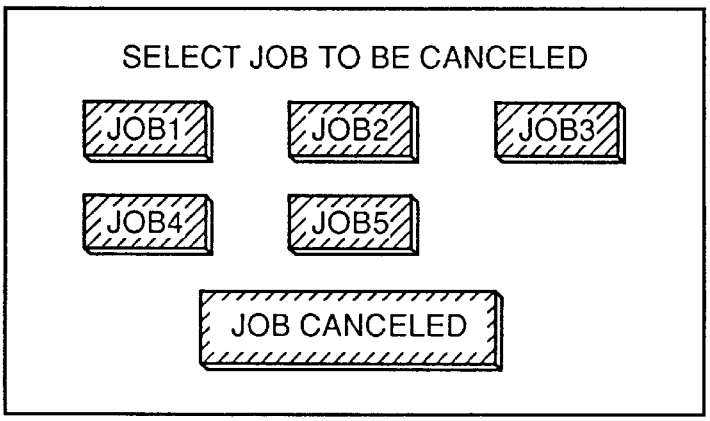
FIG. 18 is a view showing a display when a job is canceled.

FIG. 18 shows a display when a job is canceled. When the JOB deletion key on the panel is pressed, the display appears. In the display, there are shown a key to select a job to be canceled, and a job cancellation key to cancel the selected job. #121 in FIG. 12 corresponds to turning on of job deletion key 99 and turning on of the job select key.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a device for making prints from a plurality of print jobs;

a first memory for storing the plurality of print jobs;

a second memory for storing a maximum number of prints;

means for inputting a number of prints of a new print job into said first memory;

means for calculating a section remaining number generated from the maximum number, a number of prints already made and the plurality of print jobs stored in the first memory;

means for comparing the section remaining number with the input number; and warning means for giving a warning in response to a result of comparison by said comparator means if the input number exceeds the section remaining number.

2. The image forming apparatus as recited in claim 1, wherein said plurality of lobs stored in said first memory includes a job under execution and a job waiting to be printed.

3. The image forming apparatus as recited in claim 2, further comprising means for canceling the job waiting to be printed.

4. The image forming apparatus as recited in claim l, further comprising means for displaying the section remaining number.

5. The image forming apparatus as recited in claim 1, further comprising control means for executing said comparing means and said warning means only if a section management mode is selected.

6. The image forming apparatus as recited in claim 1, further comprising means for executing operation of said comparing means for each section if a section management mode for managing a plurality of sections is selected.

7. The image forming apparatus as recited in claim 1, wherein said device for making prints makes prints of a plurality of document sheets, said calculating means has a counter for counting the number of the document sheets, and calculates said section remaining number based on a result of counting by said counter and a result of input by said inputting means.

8. An image forming apparatus comprising:

a device for making prints from a plurality of print jobs;

a first memory for storing the plurality of print jobs;

a second memory for storing a maximum number of prints;

means for inputting a number of prints of a new print job into the first memory;

calculator means for calculating a section remaining number generated from the maximum number, a number of prints already made and the plurality of print jobs stored in the first memory;

comparator means for comparing the section remaining number and the input number; and means for changing the plurality of print jobs in the first memory if the input number is larger than the section remaining number.

9. The image forming apparatus as recited in claim 8, further comprising means for canceling input of one of the first memory and the inputting means.

10. An image forming apparatus comprising:

a device for making prints from a plurality of print jobs;

a first memory for storing the plurality of print jobs;

a second memory for storing a maximum number of prints;

means for inputting a number of prints of a new print job into the first memory;

means for calculating a section remaining number generated from the maximum number, a number of prints already made and the plurality of print jobs stored in response to the input by the input means; and means for indicating the section remaining number calculated by the calculator means.

11. The image forming apparatus as recited in claim 10, further comprising means for canceling a job waiting to be printed.

12. The image forming apparatus as recited in claim 10, further comprising:

means for comparing the section remaining number with the input number; and means for giving a warning in response to a result of comparison by the comparator means.

13. An image forming method of an apparatus comprising the steps of:

inputting a number of prints of a new job;

calculating a section remaining number from a predetermined maximum number and a number of prints already made;

comparing the section remaining number with the input number; and issuing a response from the apparatus to a result of comparing step.

14. The image forming method of claim 13, wherein the response comprises a warning if the input number exceeds the section remaining number.

15. The image forming method of claim 13, further comprising the step of executing the new job if the input number does not exceed the section remaining number.

16. An image forming system comprising:

a print device for making prints in response to a job request;

an input device for inputting a number of prints of a new job;

a calculator for calculating a section remaining number from a predetermined maximum number and a number of prints already made;

a comparator for comparing the section remaining number with the input number; and a warning device for issuing a warning in response to a result of the comparison.

17. The image forming method of claim 16, wherein the warning device issues the warning if the input number exceeds the section remaining number.

18. An image forming method of an apparatus comprising the steps of:

inputting a number of prints of a new job;

calculating a section remaining number from a predetermined maximum number and a number of prints already made;

comparing the section remaining number with the input number; and changing the input print job by the apparatus in response to a result of the comparing step.

19. The image forming method claim 18, wherein the input number is changed if the input number exceeds the section remaining number.

20. An image forming system comprising:

a print device for making prints in response to a job request for a new job;

an input device for inputting a number of prints of the new job;

a calculator for calculating a section remaining number from a predetermined maximum number and a number of prints already made;

a comparator for comparing the section remaining number with the input number; and a changing device for changing the new job in response to a result of the comparator.

21. The image forming system of claim 20, wherein the changing device changes the new job if the input number exceeds the section remaining number.

* * * * *